US007350502B2

(12) United States Patent
Meistrick et al.

(10) Patent No.: US 7,350,502 B2
(45) Date of Patent: Apr. 1, 2008

(54) APPARATUS AND METHOD FOR CONTROLLING EXHAUST PRESSURE

(75) Inventors: Zdenek Meistrick, Bloomfield, CT (US); Todd Perkins, Windsor Locks, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 11/030,895

(22) Filed: Jan. 10, 2005

(65) Prior Publication Data

US 2006/0107922 A1 May 25, 2006

Related U.S. Application Data

(60) Provisional application No. 60/629,382, filed on Nov. 22, 2004.

(51) Int. Cl.
*F02D 9/06* (2006.01)

(52) U.S. Cl. ..... 123/323; 188/273

(58) Field of Classification Search ..... 123/323; 60/324, 292

See application file for complete search history.

(56) References Cited

U.S. PATENT DOCUMENTS

| | | | | |
|---|---|---|---|---|
| 3,838,670 | A | 10/1974 | King | |
| 4,408,627 | A | 10/1983 | Harris | |
| 4,669,585 | A | 6/1987 | Harris | |
| 4,682,674 | A * | 7/1987 | Schmidt | 188/273 |
| 4,750,459 | A | 6/1988 | Schmidt | |
| 4,848,523 | A | 7/1989 | Suzuki | |
| 4,909,034 | A | 3/1990 | Kakuta | |
| 5,079,921 | A | 1/1992 | McCandless et al. | |
| 5,372,109 | A | 12/1994 | Thompson et al. | |
| 5,394,901 | A | 3/1995 | Thompson et al. | |
| 5,435,347 | A | 7/1995 | Gillingham | |
| 5,630,392 | A | 5/1997 | Harris | |
| 5,638,926 | A | 6/1997 | McCrickard | |
| 6,109,027 | A * | 8/2000 | Schaefer | 60/324 |
| 6,179,096 | B1 | 1/2001 | Klnerson et al. | |
| 6,273,058 | B1 * | 8/2001 | Wagner | 123/323 |
| 6,305,349 | B1 * | 10/2001 | Harris | 123/323 |
| 6,347,619 | B1 * | 2/2002 | Whiting et al. | 123/568.12 |
| 6,394,077 | B1 * | 5/2002 | Choi | 123/568.14 |
| 2003/0019470 | A1 | 1/2003 | Anderson et al. | |
| 2003/0234378 | A1 | 12/2003 | Hartley | |

* cited by examiner

*Primary Examiner*—Willis R. Wolfe
*Assistant Examiner*—Johnny H. Hoang
(74) *Attorney, Agent, or Firm*—David R. Yohannan, Esq; Kelley Drye & Warren LLP

(57) ABSTRACT

An apparatus and method of controlling exhaust pressure in an internal combustion engine are disclosed. In one embodiment the apparatus may comprise: a housing; a valve disposed in the housing; an orifice formed in the valve, wherein the orifice defines a gas flowpath through the valve; and a shaft slidably disposed in a bore formed in the valve, the shaft movable between a first position, in which gas is substantially prevented from flowing through said orifice, and a second position in which gas is permitted to flow through said orifice. The position of the shaft may be selectively varied in response to an actuating force.

27 Claims, 12 Drawing Sheets

APPARATUS AND METHOD FOR CONTROLLING EXHAUST PRESSURE

CROSS-REFERENCE TO RELATED PATENT APPLICATION

This application claims priority on U.S. Provisional Patent Application No. 60/629,382, for Apparatus and Method for Controlling Exhaust Pressure, filed on Nov. 22, 2004, the entirety of which is incorporated herein by reference.

FIELD OF THE INVENTION

Embodiments of the present invention relate to apparatus and methods for controlling exhaust pressure in an internal combustion engine.

BACKGROUND OF THE INVENTION

Flow control of exhaust gas through an internal combustion engine has been used in order to provide vehicle engine braking. Engine braking may include exhaust brakes, compression release type engine brakes, bleeder type engine brakes, and/or any combination thereof. The general principle underlying such brakes is the utilization of gas compression generated by the reciprocating pistons of an engine to retard the motion of the pistons and thereby help to brake the vehicle to which the engine is connected.

Exhaust brakes are known to be useful to help brake a vehicle. Exhaust brakes may generate increased exhaust gas back pressure in an exhaust system, including an exhaust manifold, by placing a restriction in the exhaust system downstream of the exhaust manifold. Such restriction may take the form of a turbocharger, an open and closeable butterfly valve, or any other means of partially or fully blocking the exhaust system.

By increasing the pressure in the exhaust manifold, an exhaust brake also increases the residual cylinder pressure in the engine cylinders at the end of the exhaust stroke. Increased pressure in the cylinders, in turn, increases the resistance encountered by the pistons on their subsequent up-strokes. Increased resistance for the pistons results in braking the vehicle drive train which may be connected to the pistons through a crank shaft.

In some known vehicle braking systems, exhaust brakes have been provided such that the restriction in the exhaust system is either fully in place or fully out of place. These exhaust brakes may produce levels of braking which are proportional to the speed of the engine (RPM) at the time of exhaust braking. The faster the engine speed, the greater the pressure of the gas in the exhaust manifold and cylinders. The higher pressure results in increased resistance to the up-stroke of the piston in the cylinder and therefore, increased braking.

Because the exhaust system and engine cannot withstand unlimited pressure levels, many systems include exhaust brake restrictions that are designed such that their operation at a rated maximum engine speed will not produce unacceptably high pressures in the exhaust system and/or engine that exceed a pressure limit. At engine speeds below the rated maximum engine speed, however, these exhaust brake restrictions may produce pressures that are lower than necessary. As a result, less than optimum braking may occur below the rated maximum engine speed.

In some known vehicle braking systems, exhaust brakes have been provided with a butterfly valve having a fixed-sized opening, or orifice, formed in the valve. When the valve is closed, the orifice provides an exhaust gas flowpath through the valve. The orifice may be sized such that at the rated maximum engine speed, the orifice permits a sufficient release of pressure from the upstream side of the valve that the exhaust pressure does not exceed the pressure limit for the engine. FIG. 1 is a graph illustrating retarding power and back pressure versus engine speed (RPM) for an exhaust brake system having a valve and an orifice. The graph also illustrates an exhaust pressure limit and a targeted retarding power for a particular engine over a range of engine speeds. It is to be understood that FIG. 1 is for exemplary purposes only, and the relative values for retarding power and exhaust back pressure may vary depending on a variety of factors, such as, for example, the specifications of the vehicle engine.

With reference to FIG. 1, when the exhaust brake is activated the butterfly valve closes and exhaust pressure is generated upstream of the valve. If the exhaust brake is operated without the orifice, or with the orifice in a fully closed position (closed orifice), increased exhaust pressure, and, correspondingly, increased retarding power may result. At low to mid-range engine speeds (shown generally to the left of the heavy vertical line in FIG. 1), the exhaust brake with closed orifice generates exhaust back pressure that is below the engine pressure limit. At higher engine speeds (shown generally to the right of the heavy vertical line in FIG. 1), however, the exhaust brake in the fully closed orifice position may produce unacceptably high exhaust pressures. When the exhaust brake is operated with the orifice in an open position (fixed orifice), the generated exhaust back pressure remains below the pressure limit, even at higher engine speeds. However, because lower exhaust pressures are generated, less than optimal retarding powers may be achieved. Thus, what is needed is an exhaust brake system and method adapted to optimize engine retarding power by maintaining exhaust pressure at higher engine speeds substantially near the exhaust pressure limit, without exceeding that limit.

In some known vehicle braking systems, exhaust brakes have been provided with variable restriction. These variable restrictions may be designed such that their operation is dependant on a predetermined back pressure level, not the rated maximum speed. Because the restriction is not dependent on the rated maximum speed, improved braking may occur below this speed.

Some variable restriction exhaust brake systems may include a spring loaded pressure-relief valve operable to admit flow of exhaust gases along a bypass flowpath only when a prescribed back pressure is reached. When the prescribed back pressure is reached, the pressure overcomes the force of the valve spring and opens the valve to relieve the pressure. When the valve opens, however, the flow of the gas through the valve may create a localized dynamic pressure drop near the valve. This pressure drop may cause the valve to close prematurely, or to rapidly close and then reopen. As a result the desired level of exhaust back pressure may not be easily maintained, and the desired level of braking may not be achieved.

Embodiments of the present invention may provide apparatus and methods for controlling exhaust pressure in an internal combustion engine. Some embodiments of the present invention may provide controlled exhaust gas back pressure to optimize one or more engine valve events, such as, for example, engine braking. Some embodiments of the present invention may control exhaust gas back pressure independent of the effect of dynamic pressure on means for controlling the exhaust pressure. Advantages of embodiments of the invention are set forth, in part, in the description which follows and, in part, will be apparent to one of ordinary skill in the art from the description and/or from the practice of the invention.

SUMMARY OF THE INVENTION

Responsive to the foregoing challenges, Applicant has developed innovative apparatus and methods for controlling exhaust pressure in an internal combustion engine. In an engine having an exhaust manifold, a valve disposed downstream of the exhaust manifold, means for controlling pressure in the exhaust manifold, and means for actuating the pressure control means, one embodiment of the method of the present invention may comprise the steps of: closing the valve; generating exhaust pressure in the exhaust manifold; applying a force to the actuating means substantially independent of the effect of pressure acting on the pressure control means; actuating the pressure control means; and controlling the level of exhaust pressure in the exhaust manifold.

Applicant has further developed a method of controlling exhaust pressure in an engine having an exhaust manifold, a valve disposed downstream of the exhaust manifold, means for controlling pressure in the exhaust manifold, and means for actuating the pressure control means. In one embodiment, the method may comprise the steps of: closing the valve; applying exhaust pressure to the pressure control means, wherein the force applied on the pressure control means by the exhaust pressure is in a direction substantially orthogonal to the actuation direction of the pressure control means; applying a force to the actuating means with a force substantially independent of the effect of pressure on the pressure control means; actuating the pressure control means; and controlling the level of exhaust pressure in the exhaust manifold.

Applicant has developed a method of controlling exhaust pressure in an engine having an exhaust manifold, a valve disposed downstream of the exhaust manifold, means for controlling pressure in the exhaust manifold, and means for actuating the pressure control means. In one embodiment, the method comprises the steps of: closing the valve; generating exhaust pressure in the exhaust manifold; applying exhaust pressure to the pressure control means, wherein the force applied on the pressure control means by the exhaust pressure is in a direction substantially orthogonal to the actuation direction of the pressure control means; applying exhaust pressure to the actuating means; and actuating the pressure control means in response to the exhaust pressure.

Applicant has developed a method of controlling exhaust pressure in an engine having an exhaust manifold, a valve having an orifice formed therein disposed in the exhaust manifold, and means for controlling the flow area through the valve orifice. In one embodiment, the method comprises the steps of: closing the valve; generating exhaust pressure in the exhaust manifold; applying the exhaust pressure to the flow area control means; controlling the size of the flow area through the valve orifice responsive to the exhaust pressure; and controlling the level of exhaust pressure in the exhaust manifold.

Applicant has further developed an apparatus for controlling exhaust pressure in an internal combustion engine having an exhaust manifold, comprising: a valve disposed in the exhaust manifold, the valve adapted to rotate about an axis of rotation; a bore formed in the valve coaxial with the axis of rotation; means for controlling pressure in the exhaust manifold, the pressure control means disposed in the valve bore; and means for actuating the pressure control means.

Applicant has developed an apparatus for controlling exhaust pressure in an internal combustion engine having an exhaust manifold, comprising: a valve disposed in the exhaust manifold; means for controlling pressure in the exhaust manifold, the pressure control means disposed in the valve; and means for actuating the pressure control means, wherein exhaust pressure acting on the actuating means provides substantially all of the force required to actuate the pressure control means.

Applicant has developed an apparatus for controlling exhaust pressure in an internal combustion engine, comprising: a housing; a valve disposed in the housing; an orifice formed in the valve, wherein the orifice defines a gas flowpath through the valve; a shaft slidably disposed in a bore formed in the valve, the shaft movable between a first position, in which gas is substantially prevented from flowing through the orifice, and a second position in which gas is permitted to flow through the orifice; and means for actuating the shaft.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Figure 1:
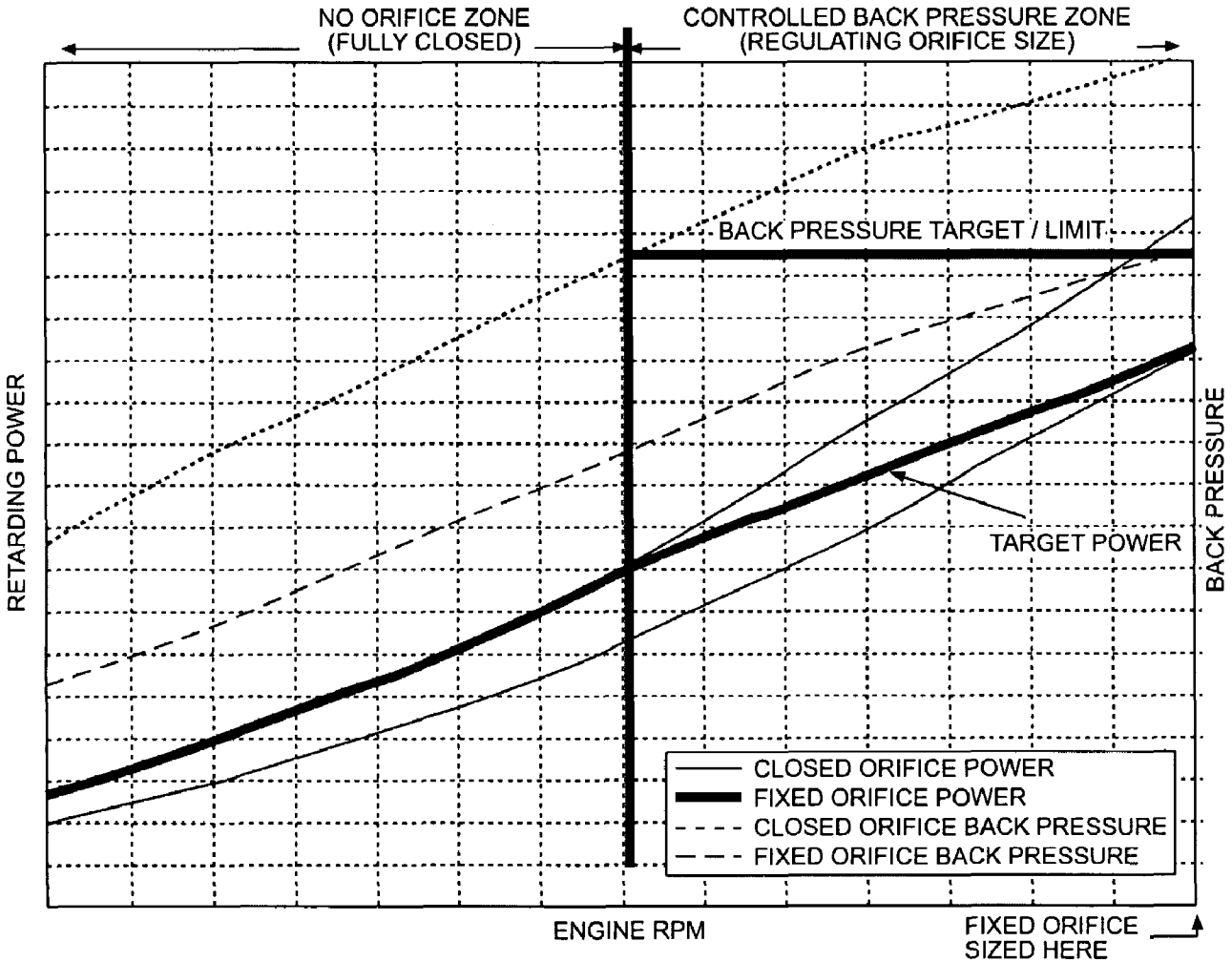
FIG. 1 is a graph illustrating retarding power and exhaust pressure as a function of engine speed for an exemplary exhaust brake system.
Figure 2:
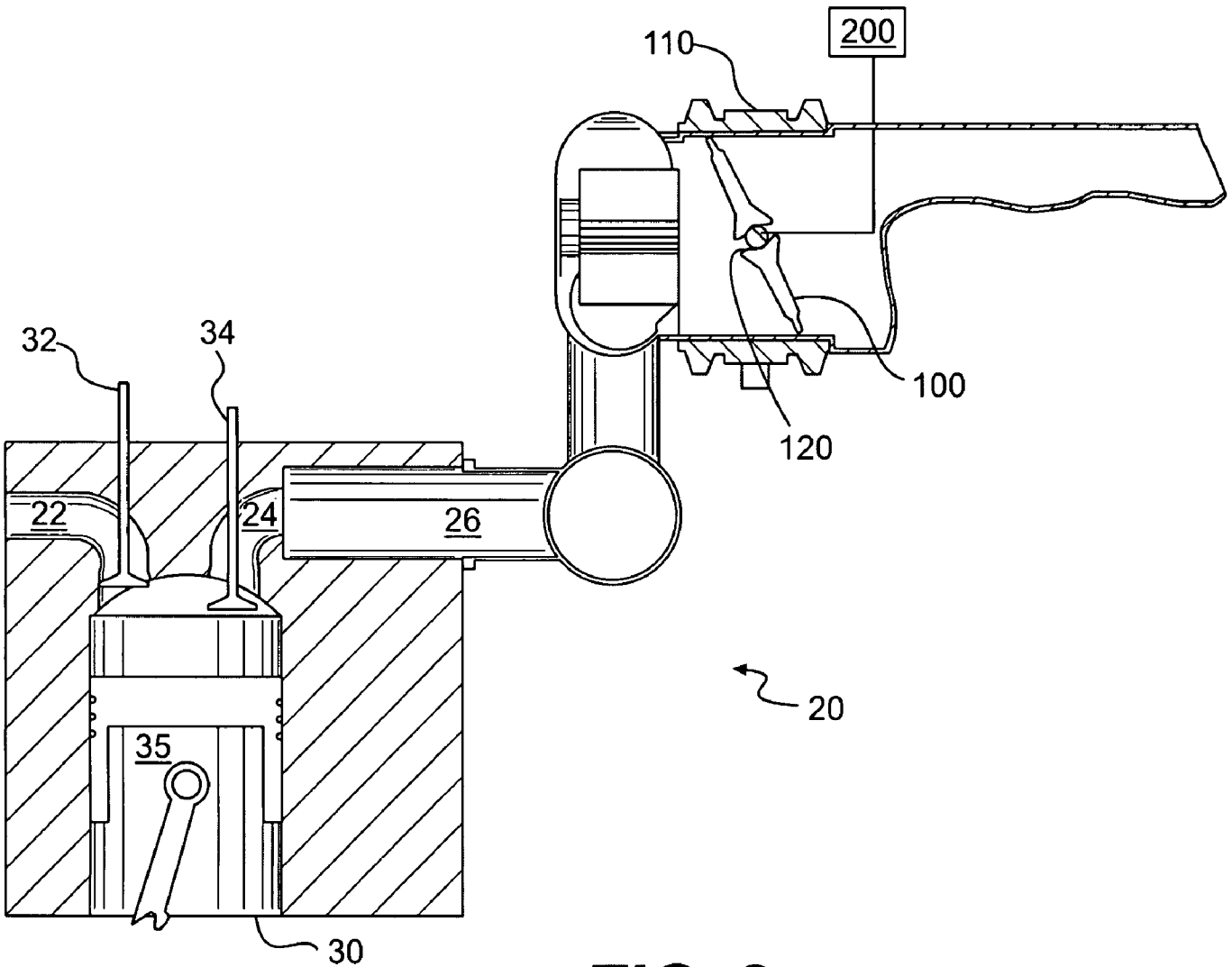
FIG. 2 is a schematic sectional view of an engine cylinder, exhaust system, and exhaust pressure control system according to an embodiment of the present invention.

Reference will now be made in detail to embodiments of the present invention, examples of which are illustrated in the accompanying drawings. With reference to FIG. 2, a vehicle engine 20 may have a cylinder 30 in which a piston 35 may reciprocate to provide intake, compression, expansion, and exhaust strokes. It is contemplated that the engine 20 may be adapted for four-cycle and/or two-cycle engine applications. At the top of the cylinder 30, there may be at least one intake valve 32 and one exhaust valve 34. The intake valve 32 and the exhaust valve 34 may be opened and closed to provide communication with an intake gas passage 22 and an exhaust gas passage 24, respectively. The exhaust gas passage 24 may communicate with an exhaust manifold 26, which may also have inputs from other exhaust gas passages (not shown). Downstream of the exhaust manifold 26 there may be an exhaust restriction means 100 disposed in a housing 110. Means 120 for controlling the pressure in the exhaust manifold 26 may be disposed in the housing 110. In one embodiment, the pressure control means 120 may include an orifice formed in the exhaust restriction means 100 through which exhaust gas may flow.

The exhaust restriction means 100 may be selectively activated to restrict the flow of exhaust gas from the manifold. An actuator 200 may move the exhaust restriction means 100 between an open position, in which gas is substantially permitted to flow from the manifold, and a closed position (as shown in FIG. 2), in which gas flow from the manifold is substantially restricted. It is contemplated that in some embodiments of the present invention, some leakage may occur past the edges of the exhaust restriction means 100. When the exhaust restriction means 100 is in its closed position, exhaust gas back pressure may be generated in the manifold. The increased exhaust pressure in the manifold and/or engine cylinder may act against the engine piston and help retard the vehicle. The level of exhaust back pressure may be controlled by the pressure control means 120 such that the exhaust pressure is maintained substantially near an exhaust pressure limit for the engine, without exceeding the limit, and retarding power provided by the system is optimized. In one embodiment, the level of exhaust back pressure may be controlled by controlling the size of the flow area through the valve orifice 120. The greater the size of the flow area through the valve orifice 120, the more gas is permitted to flow through the orifice thereby reducing the level of exhaust back pressure in the manifold. The smaller the size of the flow area through the valve orifice 120, the less gas is permitted to flow through the orifice.

The exhaust pressure may be controlled in response to an actuating force applied to the pressure control means 120, or a means for actuating the pressure control means (not shown). In one embodiment of the present invention, the actuating force may comprise the exhaust manifold pressure. In alternative embodiments, it is contemplated that the actuating force may be provided by one or more of the following: the exhaust manifold pressure, a controlled pressure from a pressure source, a mechanical force, an electromechanical force, a motor, and/or any other suitable actuating force.

The area at which the actuating force is applied to the pressure control means 120 (or the means for actuating the pressure control means) is preferably different than the area at which the exhaust gas flow, and correspondingly, the exhaust pressure, is controlled. In this manner, the actuating force may be applied to the pressure control means 120 (or the means for actuating the pressure control means) substantially independent of the effect of pressure acting on the pressure control means. For example, the valve orifice flow area, and correspondingly, the level of exhaust back pressure, may be controlled substantially independent of the effect of dynamic pressure that may occur as a result of gas flow through the orifice.

Figure 3:
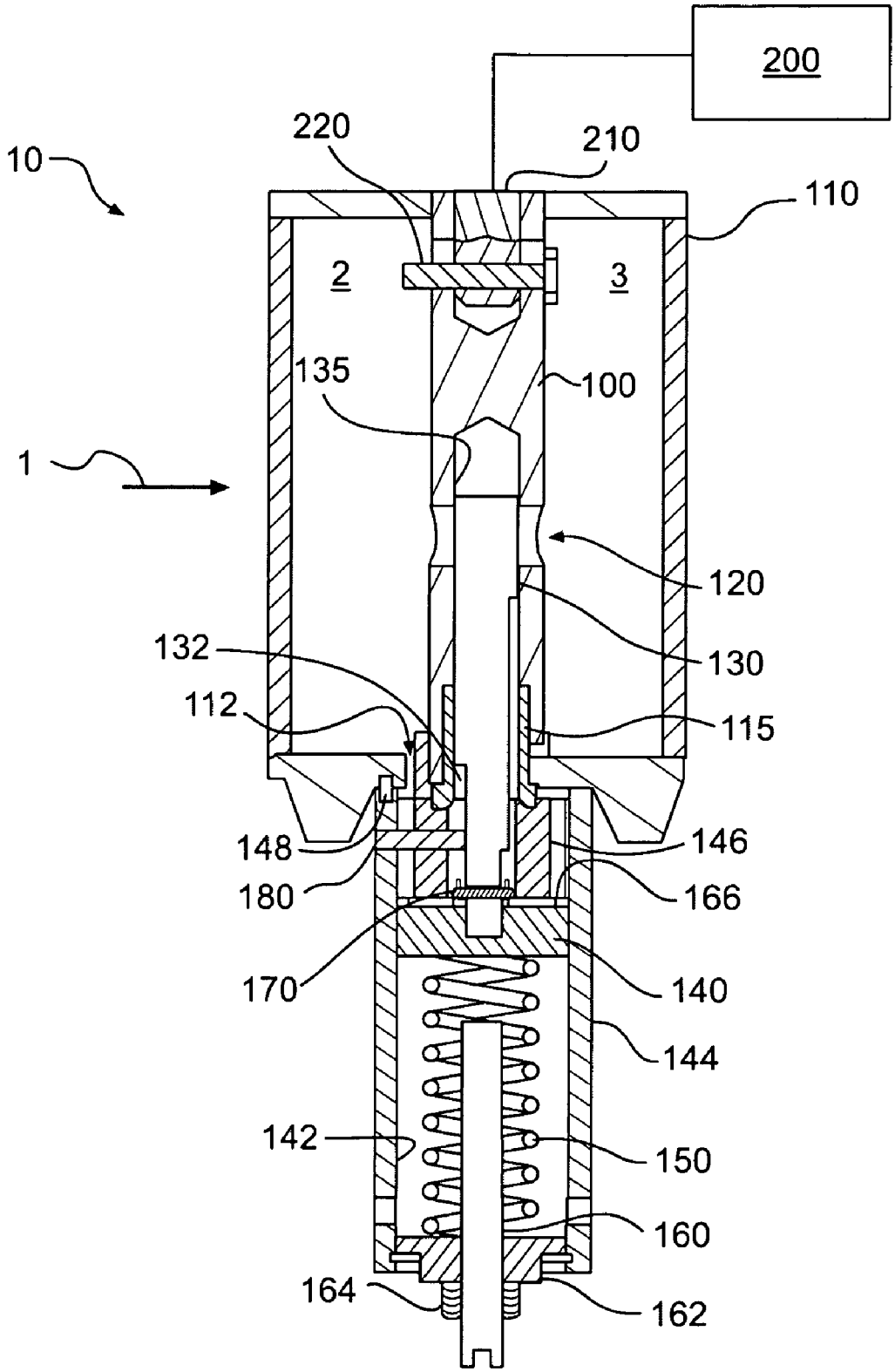
FIG. 3 is a schematic sectional view of an exhaust pressure control system according to a first embodiment of the present invention.

With reference to FIG. 3, a first embodiment of a system 10 for controlling exhaust pressure will be described in detail. The system 10 includes a valve 100 disposed in a housing 110. The housing 110 may be secured to an engine component, such as, for example, an exhaust manifold (not shown). The valve 100 is adapted to move between an open position and a closed position (shown in FIG. 3). In the open position, the valve 100 substantially permits the flow of gas (in the direction of the arrow 1 shown in FIG. 3) through the housing 110 from an upstream side 2 of the valve to a downstream side 3 of the valve. In the closed position, the valve 100 substantially restricts the flow of gas through the housing 110. In this manner, when the valve 100 is in its closed position exhaust pressure may be generated in the manifold upstream of the valve.

In one embodiment of the present invention, the valve 100 comprises a butterfly valve. The valve 100 may comprise, for example, a centered butterfly valve, and/or an off-set butterfly valve. Other valves suitably adapted to control the flow of gas through the housing 110 are considered to be well within the scope of the present invention.

The valve 100 may be operatively connected to a valve actuator 200. The valve actuator 200 is adapted to selectively rotate the valve 100 within the housing 110 between the open position, in which the valve 100 substantially permits the flow of gas through the housing 110, and the closed position, in which the valve 100 substantially restricts the flow of gas through the housing 110. In one embodiment, the valve 100 may be connected to a bushing member 115 which is securely fit in the housing 110. The bushing member 115 may guide the valve 100 as it rotates within the housing 110.

In one embodiment of the present invention, the valve 100 may be connected to a valve actuator shaft 210 by a securing means 220. The securing means 220 may comprise a screw, a rivet, or other suitable means for securing the valve 100 to the actuator shaft 210. The valve actuator 200 is adapted to rotate the actuator shaft 210, which, in turn, rotates the valve 100 between its open and closed positions.

Figure 4:
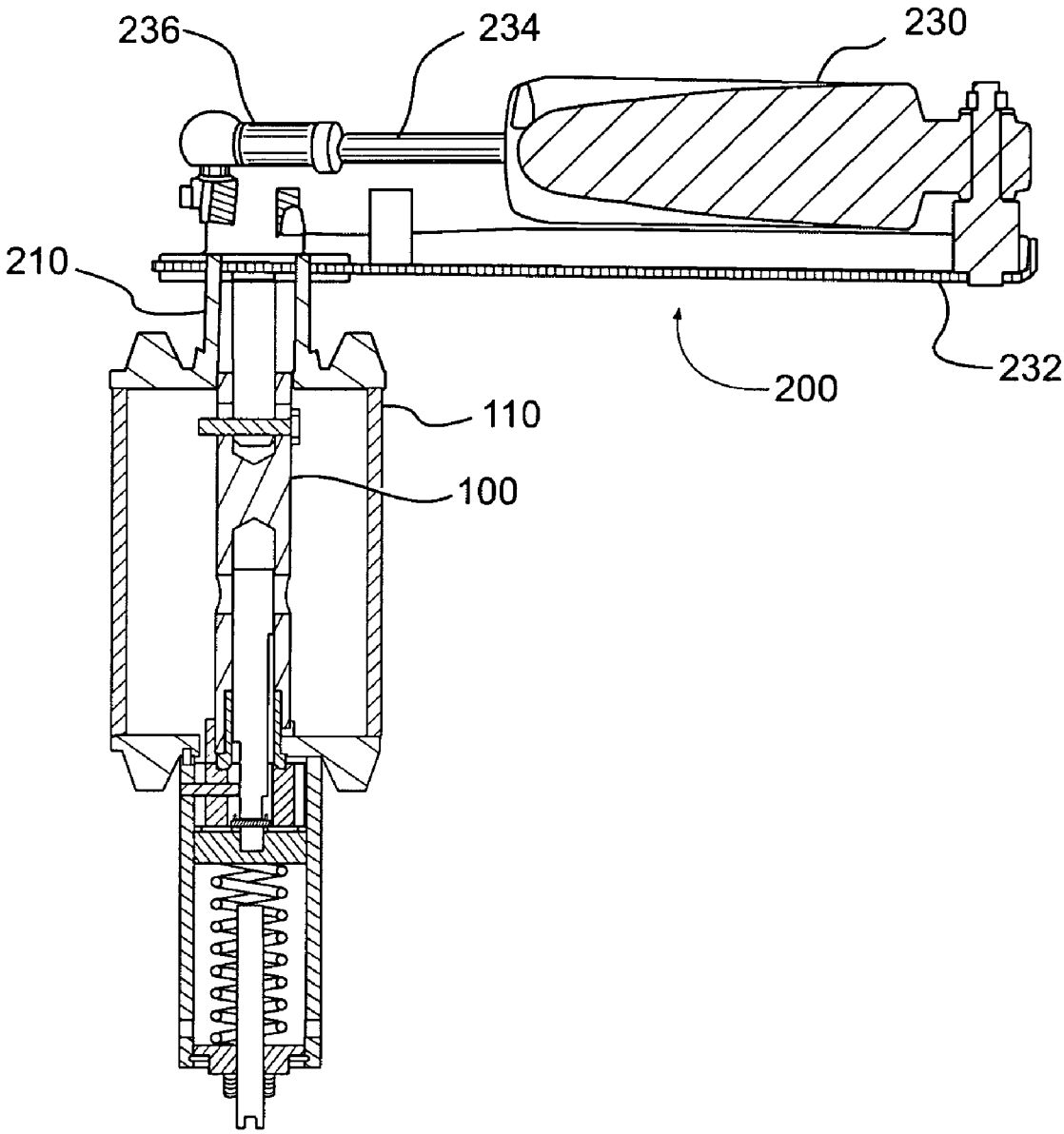
FIG. 4 is a schematic sectional view of the system shown in FIG. 3 with a pneumatic valve actuator.

An embodiment of the valve actuator 200 is shown in FIG. 4. In one embodiment, the valve actuator 200 may comprise a pneumatic actuator. The pneumatic actuator 200 may comprise a piston 230 secured to a heat shield 232, a piston rod 234, and a lever 236. When the pneumatic piston 230 is activated, by a motor (not shown) for example, the piston rod 234 moves laterally outward from the piston 230, causing the lever 236 to pivot. The motion of the piston rod 234 and the lever 236 causes the actuator shaft 210 to rotate and move the valve 100 into its closed position. Other suitable valve actuators 200, such as, for example, a hydraulic actuator, an electric actuator, and/or other suitable means for rotating the actuator shaft 210 are considered to be well with in the scope of the present invention.

With renewed reference to FIG. 3, an orifice 120 is formed in the valve 100. When the valve 100 is in its closed position, the orifice 120 defines an opening through which gas may flow from the upstream side 2 of the valve 100 to the downstream side 3 of the valve. The size, shape, and location of the orifice 120 shown in FIG. 3 is for illustrative purposes only. The orifice 120 may comprise any suitable configuration through which gas may flow without departing from the scope of the present invention. A bore 135 is formed in the valve 100 preferably coaxial with the axis of rotation of the valve 100, as shown in FIG. 3. The valve bore 135 is disposed such that the bore 135 intersects with the orifice 120. In one embodiment, the orifice 120 may be formed substantially orthogonal to the valve bore 135.

A shaft 130 is disposed in the valve bore 135. The shaft 130 is adapted to move axially in an upward and downward direction within the valve bore 135. The shaft 130 may travel upward within the valve bore 135 to a position in which the shaft 130 extends within the bore above the orifice 120, as shown in FIG. 3. In this position, the shaft 130 substantially blocks the flow of gas through the orifice 120. The shaft 130 may travel downward within the valve bore 135 to a position in which the shaft extends within the bore below the orifice 120. In this position, the flow of gas through the orifice 120 is not blocked by the shaft 130. The shaft 130 may travel between the position in which the shaft is above the orifice 120 and the position in which the shaft is below the orifice. In this manner, the shaft 130 is adapted to control the size of the flow area through the orifice 120 and control the flow of gas through the orifice 120, and, correspondingly, the level of exhaust pressure.

Figure 5:
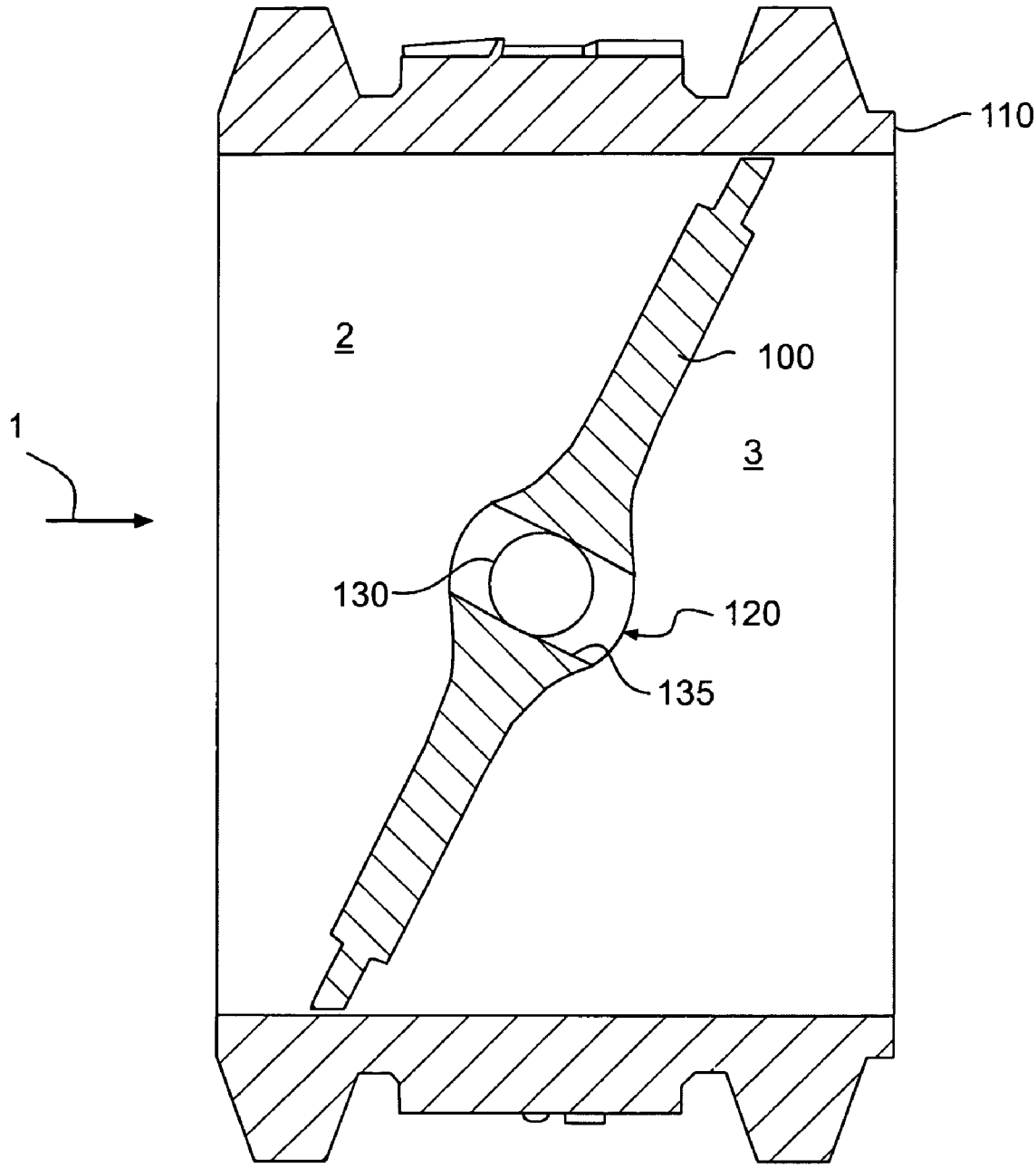
FIG. 5 is a top sectional view of the system shown in FIG. 3 illustrating a shaft configuration within a valve bore.

With reference to FIG. 5, in one embodiment of the present invention, the shaft 130 may be disposed in the valve bore 135 such that the shaft 130 may travel axially within the bore, and also may be adapted to move slightly laterally within the valve bore. When the exhaust gas acts on the shaft 130, the shaft may move laterally within the valve bore 135 such that the shaft seals the backside of the orifice 120, preventing the flow of gas from the upstream side 2 of the valve to the downstream side 3. Because the shaft 130 may not be snugly fit within the valve bore 135, this configuration also may prevent the build-up of contaminants on the shaft, which could cause sticking of the shaft.

With renewed reference to FIG. 3, the shaft 130 is operatively connected to a piston 140 which is slidably disposed in a bore 142 formed in a piston housing 144. The piston 140 is adapted to move axially in an upward and downward direction within the piston bore 142 in response to an actuating force. The motion of the piston 140 within the piston bore 142 causes corresponding upward or downward motion of the shaft 130 within the valve bore 135. In this manner, the motion of the shaft 130 and the piston 140 is substantially orthogonal to the direction of the exhaust gas flow. In one embodiment, the piston housing 144 may be secured to the housing 110 by one or more securing means 146, such as, for example, a screw or rivet. In one embodiment, one or more sealing rings 148 may sealingly engage the piston housing 144 and the housing 110.

A spring 150 may bias the piston 140 in an upward direction within the piston bore 142. In one embodiment, the spring 150 may bias the piston 140 into a position such that the shaft 130 extends within the valve bore 135 above the orifice 120, as shown in FIG. 3. In this manner, the shaft 130 may be biased into a position in which the shaft substantially blocks the flow of gas through the orifice 120. The spring biasing force may be adapted to any predetermined level. Preferably, the spring biasing force may be equal to or slightly less than the force provided by the exhaust pressure limit for the engine.

In one embodiment of the present invention, the downward travel of the piston 140 may be limited by an adjustable screw 160 disposed below the piston 140. The adjustable screw 160 extends through a screw plate 162 and into the piston bore 142, and is secured in place with a locking nut 164. The locking nut 164 may be adjusted to extend the screw 160 a desired distance within the piston bore 142. The further the screw 160 is extended within the piston bore 142, the shorter the distance the piston 140 may travel in a downward direction, and, correspondingly, the shorter the distance the shaft 130 may travel in a downward direction within the valve bore 135. The upward travel of the piston 140 may be limited by a fixed upper stop 166 secured in the piston housing 144.

Figure 6:
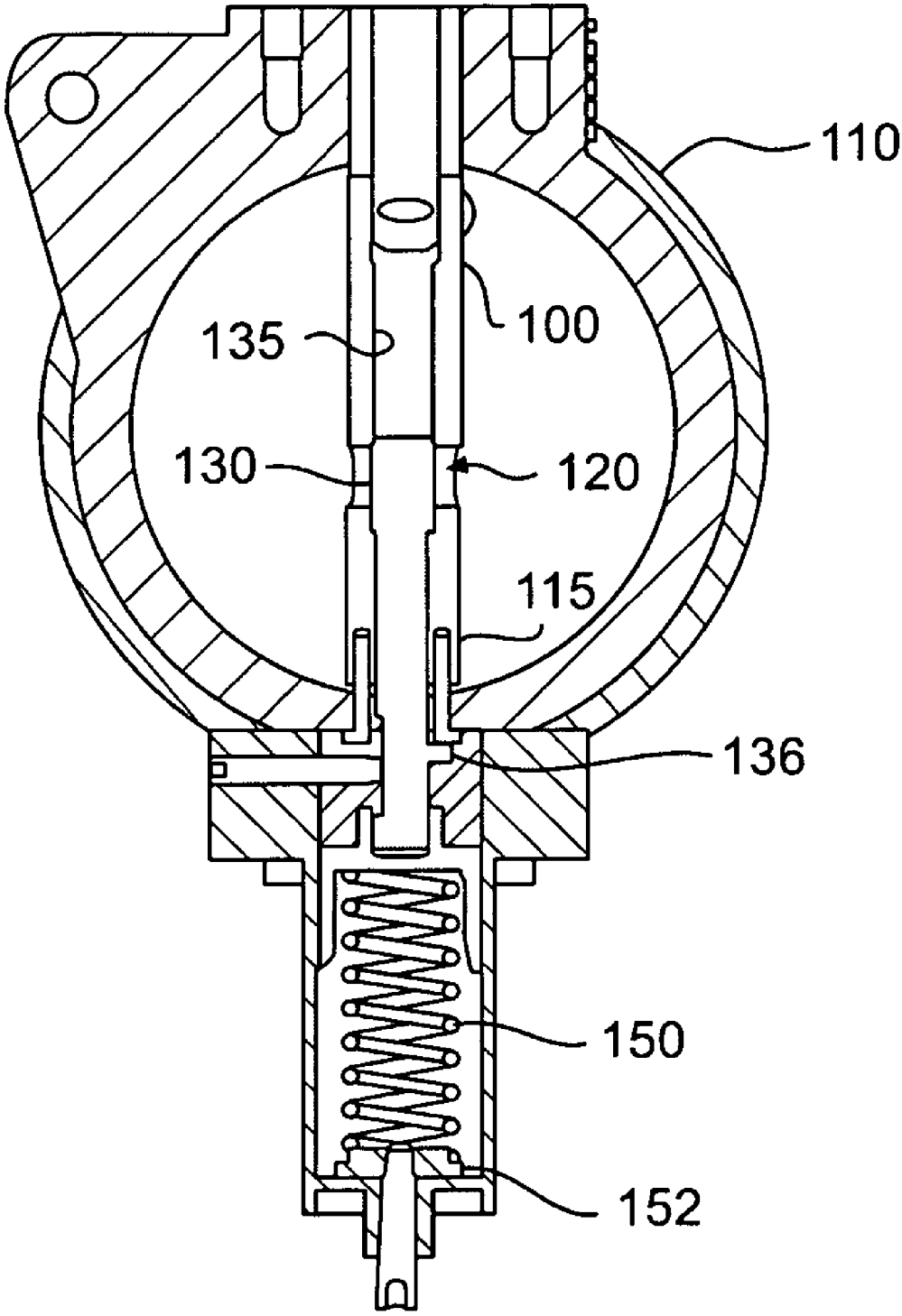
FIG. 6 is a schematic sectional view of an exhaust pressure control system according to a second embodiment of the present invention.

In an alternative embodiment of the present invention, as shown in FIG. 6, the downward travel of the piston may be limited without the adjustable screw 160. The position of a spring seat 152 may be adjusted to adjust its position within the piston bore 142, and, correspondingly, the load of the spring 150. The upward travel of shaft 130 and, correspondingly, the piston 140 may be limited by a protrusion 136 connected to the shaft 135. As the piston 140 and the shaft 130 travel upward, the protrusion 136 may contact the bushing 115 thus preventing further upward travel.

A back pressure port 112 formed in the valve housing 110 may provide communication between the upstream side 2 of the valve and the piston bore 142 above the piston 140. When the valve 100 is in its closed position, exhaust back pressure may be generated in the upstream side 2 of the valve. This pressure may communicate with the valve bore 142 through the back pressure port 112 and act on the piston 140. When the exhaust pressure is sufficient to overcome the bias of the spring 150, the pressure may cause the piston 140 to travel downward within the piston bore 142. The downward motion of the piston 140, in turn, causes the downward motion of the shaft 130 within the valve bore 135. As the shaft 130 moves downward, the flow area through the orifice 120 may increase. As a result, more gas may be permitted to flow from the upstream side 2 of the valve to the downstream side 3 of the valve through the orifice 120. As more gas is permitted to flow from the upstream side 2 of the valve 100, the level of exhaust back pressure in the exhaust manifold may be reduced.

Figure 7:
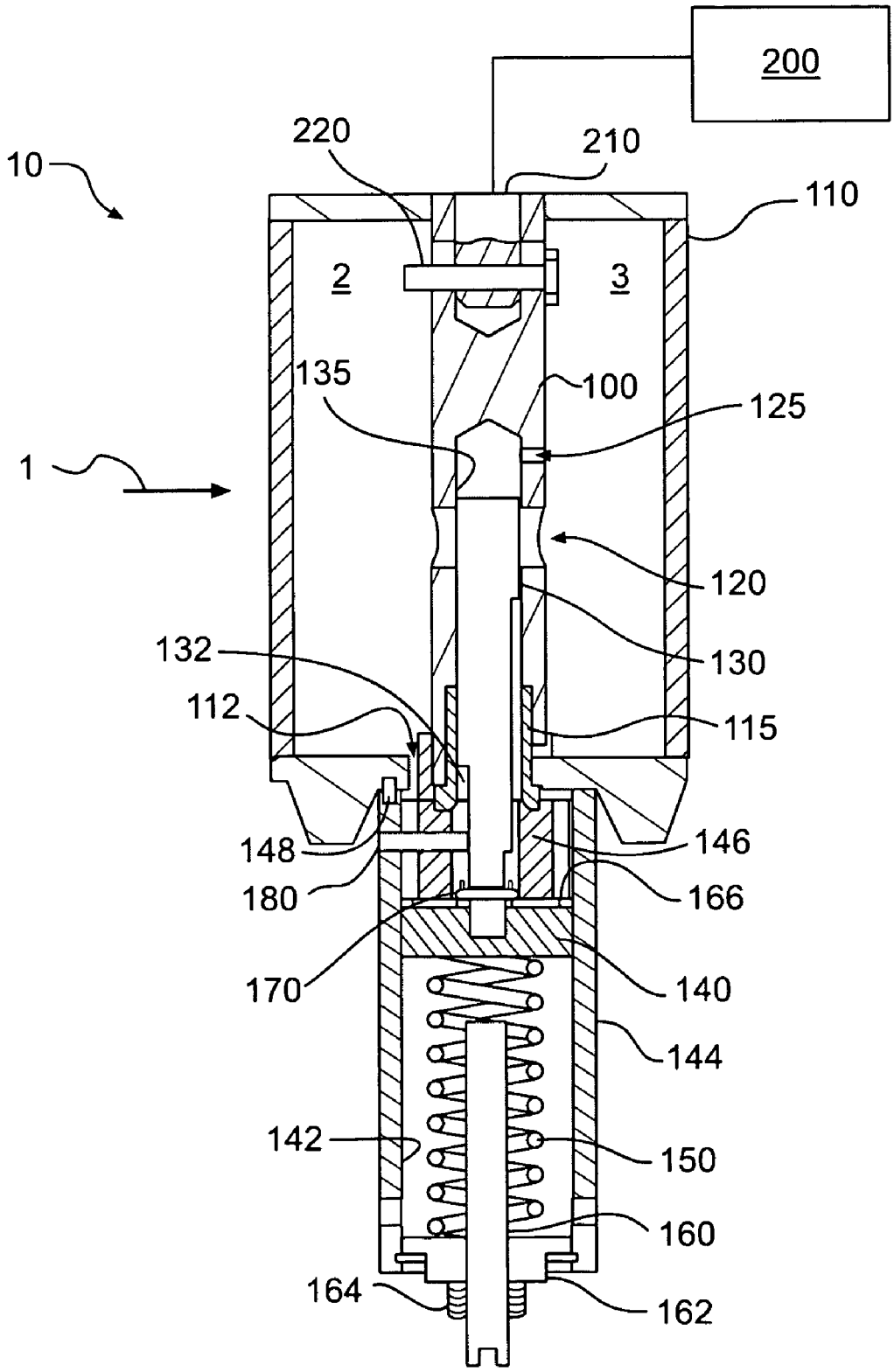
FIG. 7 is a schematic sectional view of an exhaust pressure control system according to a third embodiment of the present invention.

In one embodiment of the present invention, as shown in FIG. 7, the system 10 may further include a vent 125 formed in the valve 100 above the orifice 120. The vent 125 preferably intersects with the valve bore 135, and may provide communication between the valve bore 135 and the downstream side 3 of the valve. The vent 125 may facilitate the travel of the shaft 130 within the valve bore 135. As the shaft 130 moves upward within the valve bore 135 under the bias of the piston spring 150, pressure in the bore above the shaft may escape through the vent 135. With less pressure acting against the top of the shaft 130, the shaft 130 may return to its biased position in which the shaft blocks the orifice 120 more quickly.

Figure 8:
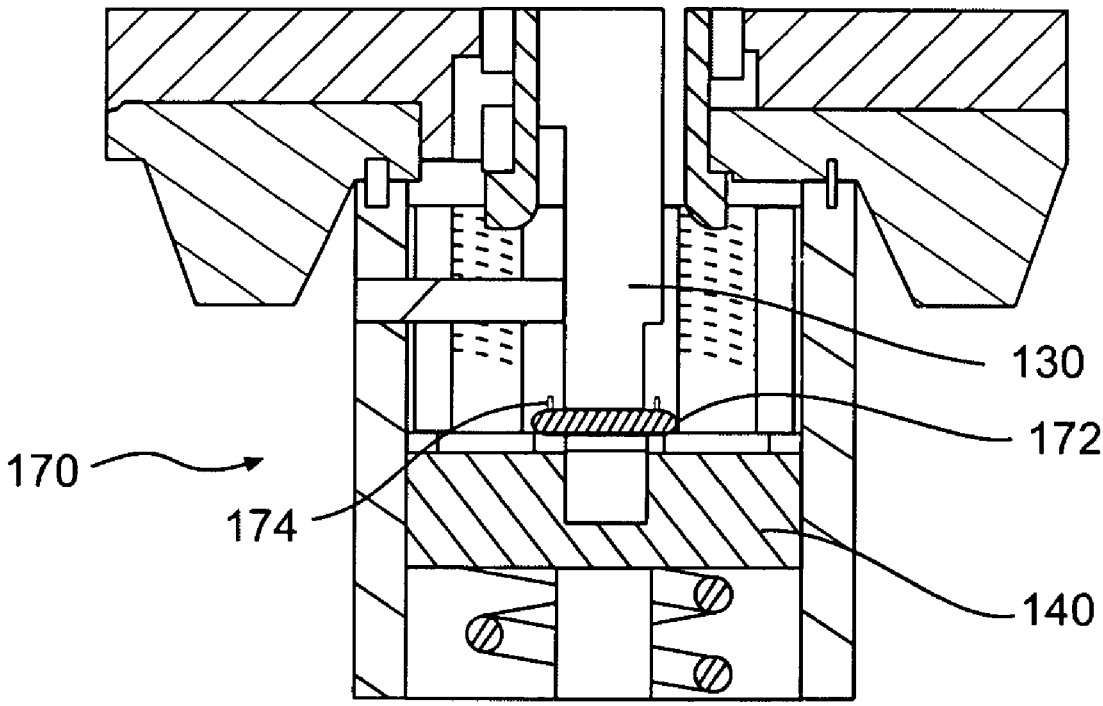
FIG. 8 is an enlarged schematic sectional view of a hinge pin assembly according to an embodiment of the present invention.

In one embodiment of the present invention, the system 10 may further include a hinge pin assembly 170 for securing the shaft 130 to the piston 140. An enlarged schematic view of the hinge pin assembly 170 is shown in FIG. 8. The hinge pin assembly 170 may include a hinge pin 172 mounted between two flanges 174 extending from the piston 140. The hinge pin 172 may be loosely fitted through a pin hole 174 formed in the lower end of the shaft 130. The loose fitting of the hinge pin 172 within the pin hole 174 may allow the shaft 130 to rotate slightly about the hinge pin. This arrangement may facilitate the alignment of the shaft 130 within the valve bore 135.

With renewed reference to FIG. 3, in one embodiment of the present invention the system 10 may further include a stabilizing pin 180 secured to the piston housing 144 and extending into the upper end of the piston bore 142. The stabilizing pin 180 may be received by a groove 132 formed in the shaft 130. The stabilizing pin 180 and the groove 132 may be adapted such that the upward and downward motion of the shaft 130 axially within the valve bore 135 is not affected by the pin 180. The stabilizing pin 180 may substantially prevent rotation of the shaft 130. In this manner, as the valve 100 rotates within the housing 110, the shaft 130 may remain stationary.

Operation of the system 10 will now be described with reference to FIGS. 3 and 4. The operation of the system 10 will be described in connection with braking operation. It is contemplated, however, that the system may be used during other engine operation, such as, for example, EGR. When braking operation is required, a control signal may be provided to the motor (not shown) which activates the piston 230. When the piston 230 is activated, the piston rod 234 moves laterally outward from the piston 230, causing the lever 236 to pivot. The motion of the piston rod 234 and the lever 236 rotates the actuator shaft 210. The rotation of the actuator shaft 210 causes the valve 100 to rotate within the housing 110 into a closed position. At this point, the shaft 130 is biased upward within the valve bore 135 by the piston spring 150 to a position in which the shaft 130 extends within the bore above the orifice 120. In this position, the shaft 130 substantially blocks the flow of gas through the orifice 120.

As the valve 100 rotates to its closed position, exhaust gas back pressure may be generated in the exhaust manifold on the upstream side 3 of the valve 100. This pressure may communicate with the valve bore 142 through the back pressure port 112 and act on the piston 140 against the biasing force of the spring 150. When the level of exhaust back pressure becomes equal to or slightly greater than the biasing force of the spring 150, the pressure may cause the piston 140 to travel downward within the piston bore 142. Because the area for providing the actuating force on the piston 140 (the back pressure port 112) is different from the area where the flow is controlled (the orifice 120), the actuating force provided by the exhaust pressure acts on the piston 140 substantially independent of the effect of dynamic pressure created by the flow of gas through the orifice 120. The downward motion of the piston 140, in turn, causes the downward motion of the shaft 130 within the valve bore 135. As the shaft 130 moves downward, the flow area through the orifice 120 may increase. As a result, more gas may be permitted to flow from the upstream side 2 of the valve to the downstream side 3 of the valve through the orifice 120. As more gas is permitted to flow from the upstream side 2 of the valve 100, the level of exhaust back pressure in the exhaust manifold may be reduced. When the level of exhaust pressure becomes equal to or slightly less than the biasing force of the spring 150, the spring 150 causes the piston 140 to move upward within the piston bore. This, in turn, causes the shaft 130 to move upward within the valve bore 135 and reduce the size of the orifice flow area. In this manner, the level of exhaust back pressure may be maintained substantially near the level of the exhaust pressure limit of the engine, and may be controlled so as to optimize the engine retarding power.

Figure 9:
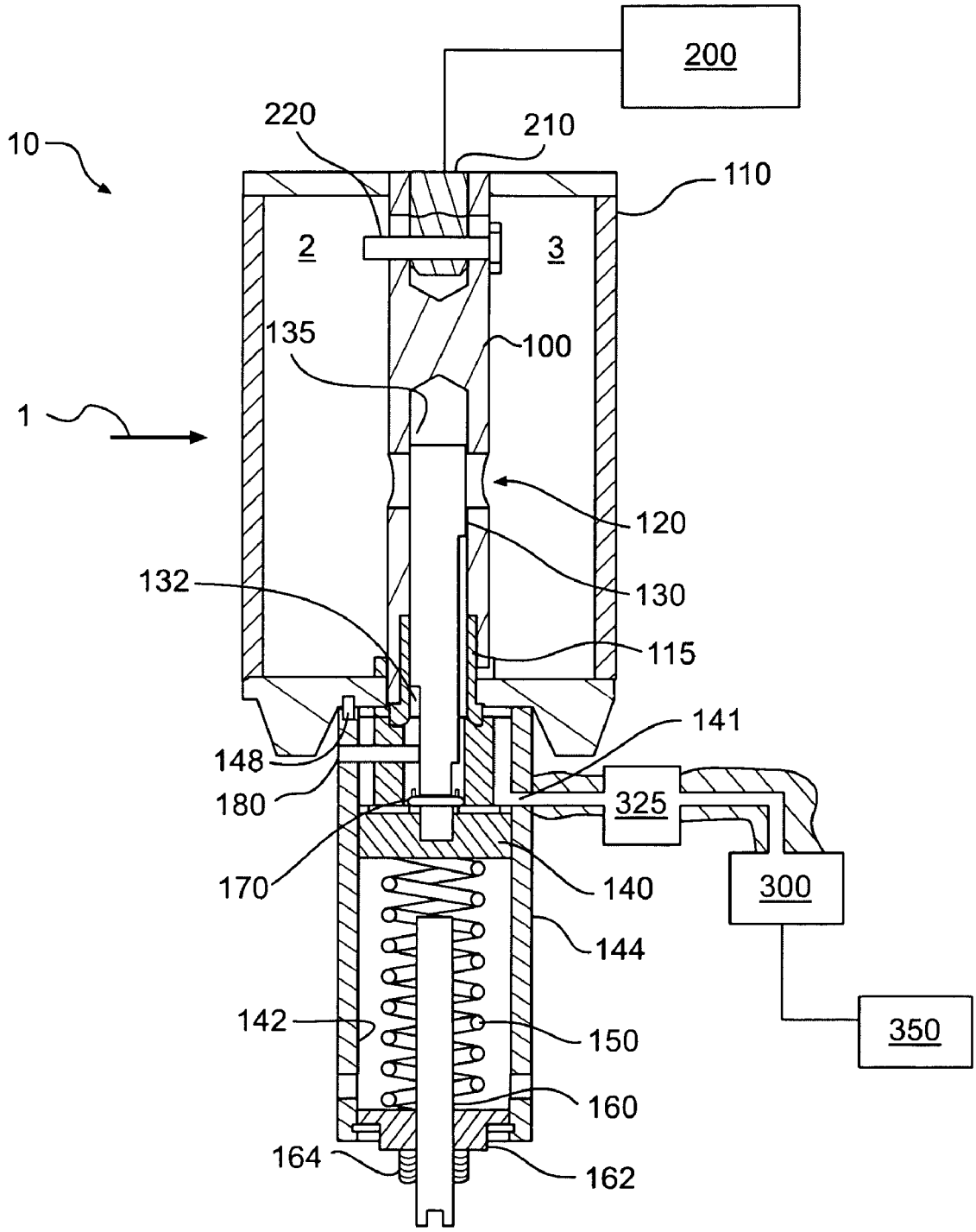
FIG. 9 is a schematic sectional view of an exhaust pressure control system according to a fourth embodiment of the present invention.

Another embodiment of the present invention is shown in FIG. 9, in which like reference numerals refer to like elements from other embodiments. The embodiment shown in FIG. 9 may operate without the back pressure port 112. The system 10 may include an inlet port 141 formed in the piston housing 144 above the piston 140. The inlet port 141 provides communication between a fluid pressure source 300 and the piston bore 142 above the piston 140. The fluid pressure source 300 may provide air pressure, hydraulic fluid pressure, and/or any other suitable pressure which may communicate with the valve bore 142. In one embodiment, the fluid pressure source 300 may comprise a compressed air supply typical on heavy-duty trucks. A pressure regulator 325 may be provided between the pressure source 300 and the piston bore 142. The pressure regulator may be used to reduce the level of pressure supplied by the pressure source (e.g. 100-120 psig) to a predetermined pressure level, which may include a pressure at or near the level of the exhaust pressure limit in the engine (e.g., 60-65 psig).

The pressure source 300 is adapted to provide a pressure (reduced to a predetermined pressure level by the pressure regulator 325) which may communicate with the valve bore 142 through the inlet port 141 and act on the piston 140 against the biasing force of the spring 150, causing the piston 140 to travel downward within the piston bore 142. The downward motion of the piston 140, in turn, causes the downward motion of the shaft 130 within the valve bore 135. As the shaft 130 moves downward, the flow area through the orifice 120 may increase. As a result, more gas may be permitted to flow from the upstream side 2 of the valve to the downstream side 3 of the valve through the orifice 120. As more gas is permitted to flow from the upstream side 2 of the valve 100, the level of exhaust back pressure in the exhaust manifold may be reduced.

The pressure source 300 may provide pressure to the piston bore 142 in response to a signal received from an engine control module (ECM) 350. The ECM 350 may include a computer and may be connected to one or more sensors located in an appropriate engine component, such as, for example, the engine cylinder and/or the exhaust manifold. The ECM 350 may determine the appropriate time to provide or not provide pressure to the piston bore 142. In this manner, the level of exhaust back pressure may be maintained substantially near the level of the exhaust pressure limit of the engine, and may be controlled so as to optimize the engine retarding power.

Figure 10:
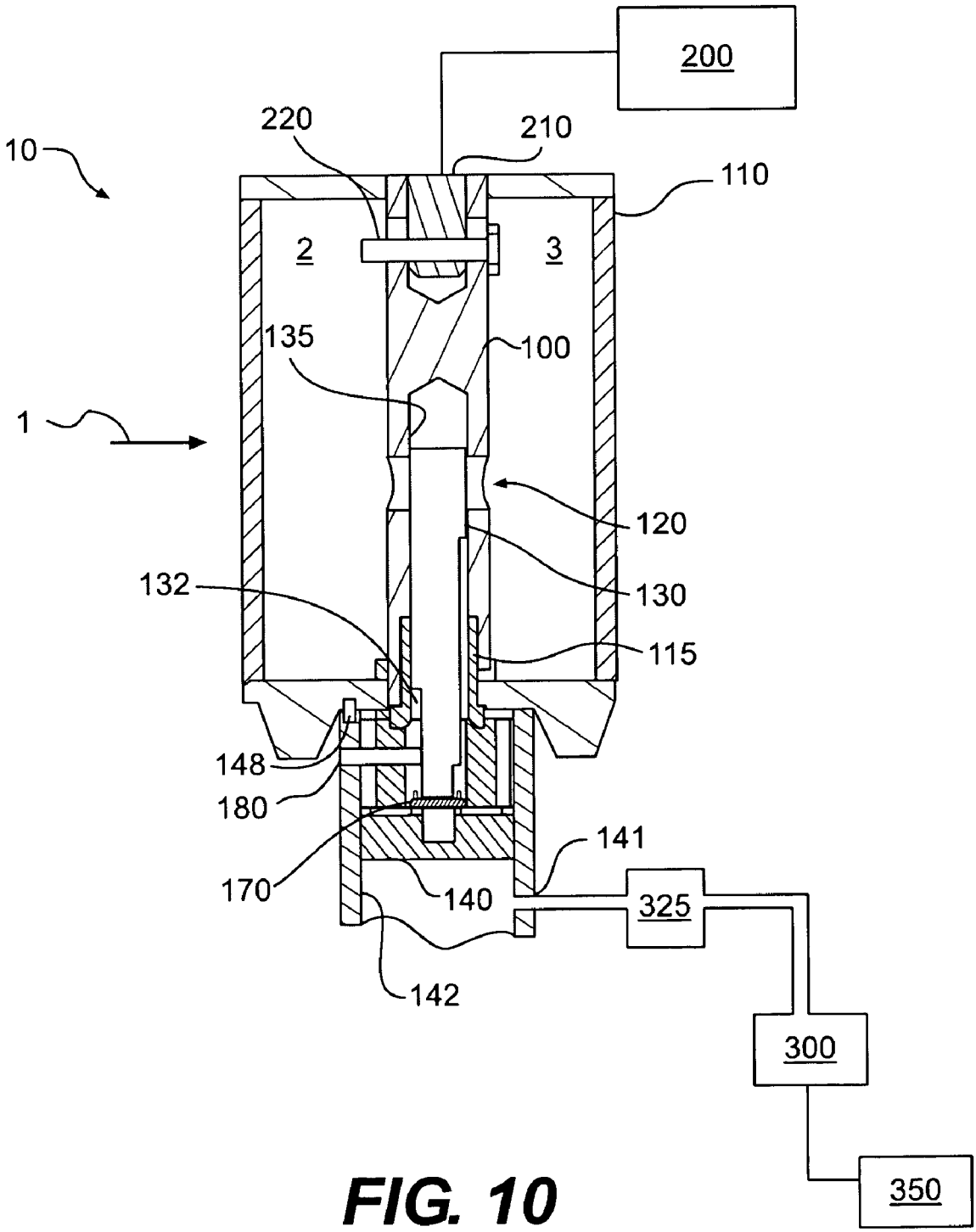
FIG. 10 is a schematic sectional view of an exhaust pressure control system according to a fifth embodiment of the present invention.

Another embodiment of the present invention is shown in FIG. 10, in which like reference numerals refer to like elements from other embodiments. The system shown in FIG. 10 is similar to the system shown in FIG. 9. The inlet port 141 may be provided below the piston 140, and the system may be provided without the spring 150. The pressure source is adapted to provide pressure which may be reduced to a predetermined level by the pressure regulator 325. In one embodiment, the pressure source 300 may provide constant pressure to the piston bore 142. The pressure may act on the piston 140 biasing the piston upward within the bore 142 such that the orifice 120 is blocked by the shaft 130. When the system is activated and the valve 100 closes, exhaust pressure upstream of the valve increases. If the exhaust pressure is less than the pressure supplied to the piston bore 142 through the inlet port 141, the shaft 130 remains in a position occluding the orifice 120. When the exhaust pressure becomes equal to or slightly greater than the pressure supplied to the bore, the position of the shaft 130 will adjust to increase the flow area through the orifice 120, reducing the exhaust pressure level until it is equal to the supplied pressure. In this manner, the level of exhaust back pressure may be maintained substantially near the level of the exhaust pressure limit of the engine, and may be controlled so as to optimize the engine retarding power.

Figure 11:
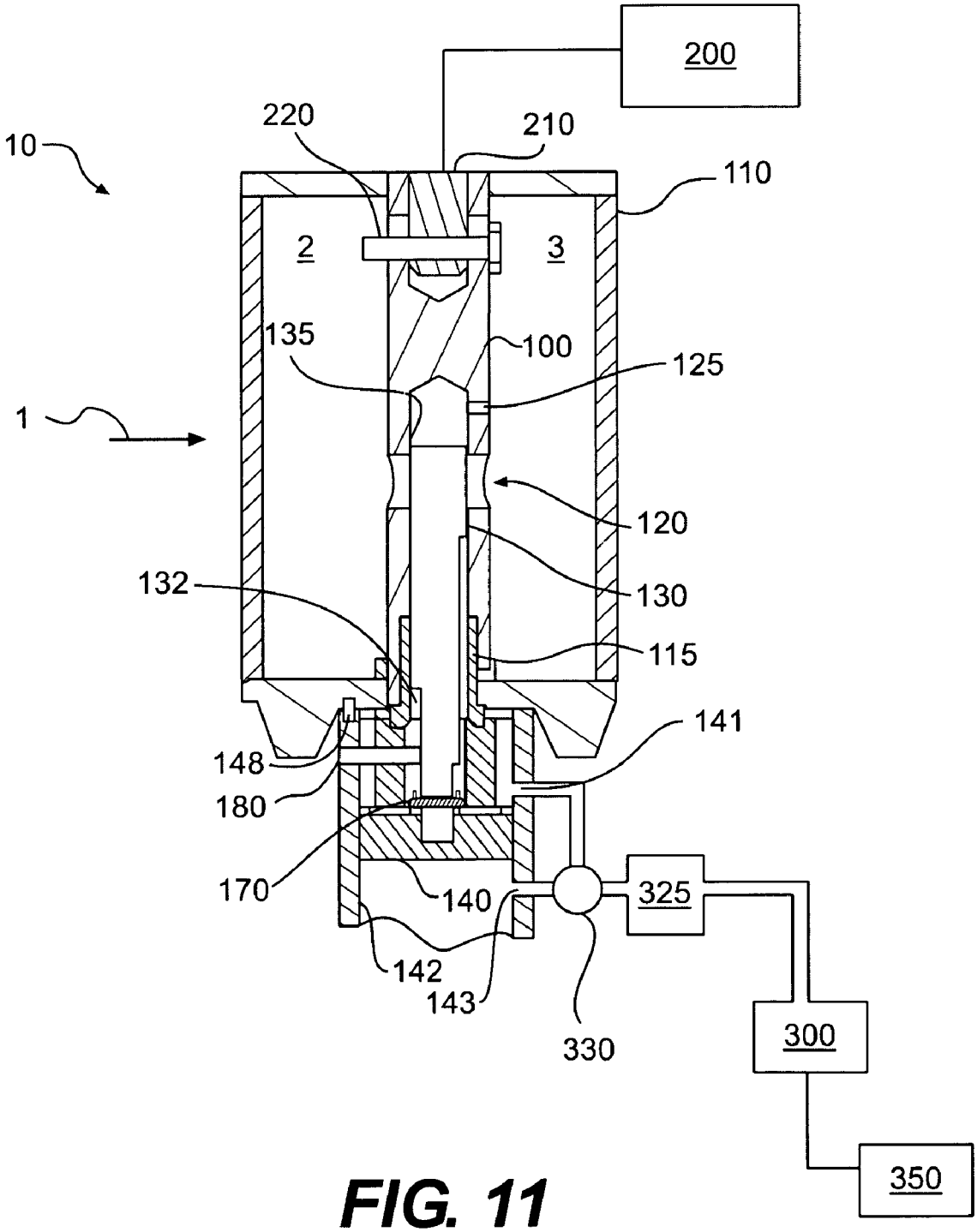
FIG. 11 is a schematic sectional view of an exhaust pressure control system according to a sixth embodiment of the present invention.

Another embodiment of the present invention is shown in FIG. 11, in which like reference numerals refer to like elements from other embodiments. The system may include a first inlet port 141 provided above the piston 140 and a second inlet port 143 provided below the piston 140. A proportioning valve 330 may be disposed between the pressure regulator 325 and the first and second inlet ports. The proportioning valve 330 may be adapted to provide a first pressure to the bore through the first inlet port 141 and a second pressure to the bore through the second inlet port 143. When the first pressure is greater than the second pressure, the resulting pressure differential on the piston 140 may cause the piston to move downward within the piston bore, which, in turn, causes the downward movement of the shaft 130. When the first pressure is less than the second pressure, the resulting pressure differential on the piston 140 may cause the piston to move upward within the piston bore, which, in turn, causes the upward movement of the shaft 130. In this manner, the position of the piston 140 may be controlled by proportioning valve 330.

Figure 12:
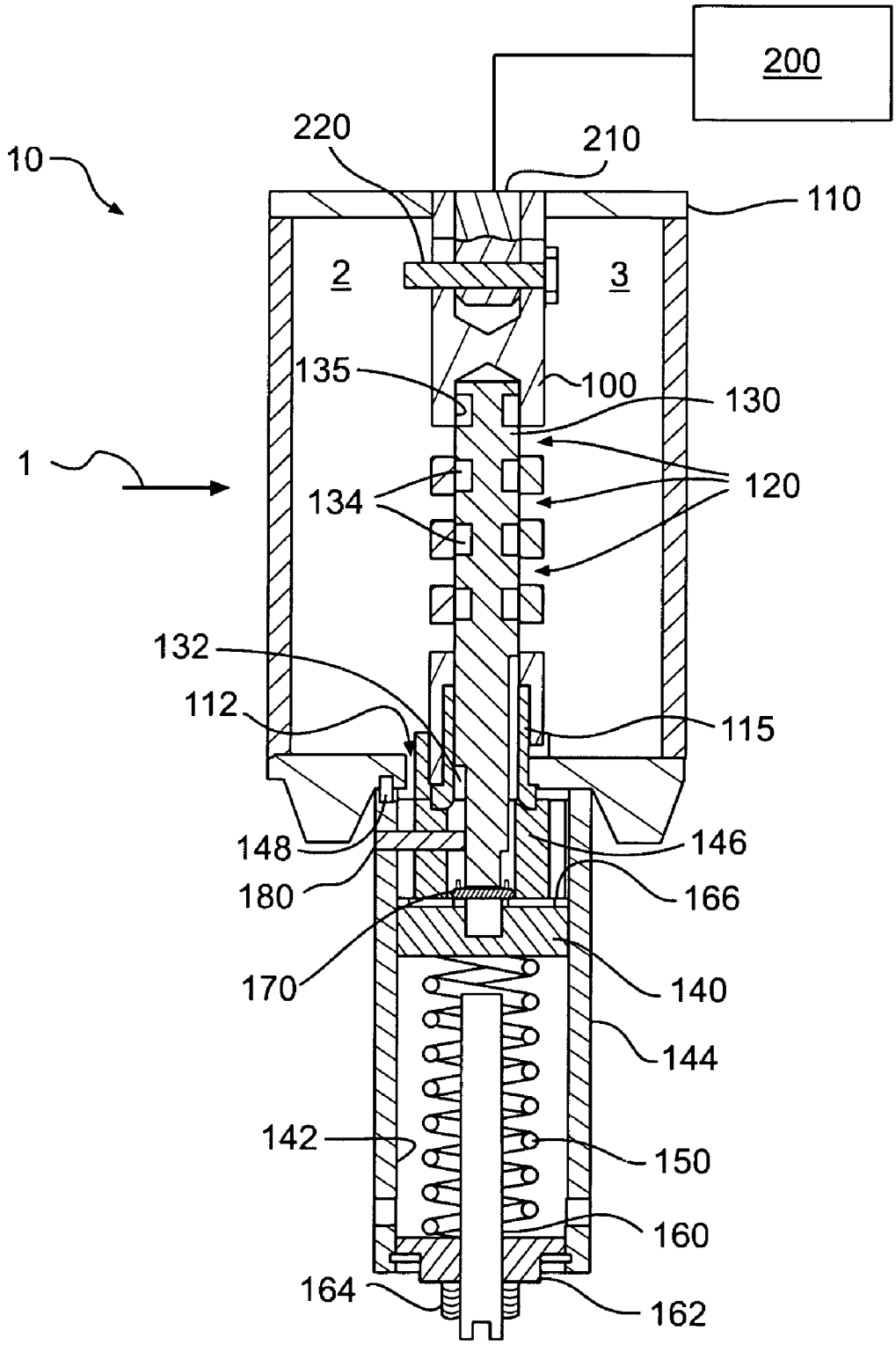
FIG. 12 is a schematic sectional view of an exhaust pressure control system according to a seventh embodiment of the present invention.

Another embodiment of the present invention is shown in FIG. 12, in which like reference numerals refer to like elements from other embodiments. The system 10 may include a plurality of orifices 120 formed in the valve 100. In one embodiment, as shown in FIG. 12, the system may include four (4) orifices 120. When the valve 100 is in the closed position, each orifice 120 defines an opening through which gas may flow from the upstream side 2 of the valve 100 to the downstream side 3. Collectively, the orifices 120 create a flow area through the valve 100. The number of orifices 120 shown in FIG. 12 is for illustrative purposes only. The system 10 may comprise any suitable number of orifices 120 to create a flow area through the valve 100 without departing from the scope of the present invention.

A plurality of annular recesses 134 may be formed in the shaft 130. The annular recesses 134 are formed in the shaft 130 such that each recess may selectively align with an orifice 120. The shaft 130 may be biased upward within the valve bore 135 by the piston spring 150 to a position in which the annular recesses 134 are not aligned with the orifices 120, as shown in FIG. 12. In this position, the shaft 130 substantially blocks the flow of gas through each orifice 120. The shaft 130 may travel downward within the valve bore 135 to a position in which each annular recess partially or fully aligns with its respective orifice 120. In this position, gas is permitted to flow around each annular recess 134 and through each orifice 120 such that the gas flowpath is only partially blocked, or not blocked, by the shaft 130.

Operation of the system 10 shown in FIG. 12 is substantially as described above in connection with FIG. 3. When braking operation is required, a control signal may be provided to actuate the valve 100. As the valve 100 rotates to its closed position, exhaust gas back pressure may be generated in the exhaust manifold on the upstream side 3 of the valve 100. This pressure may communicate with the valve bore 142 through the back pressure port 112 and act on the piston 140 against the biasing force of the spring 150. When the level of exhaust back pressure becomes equal to or slightly greater than the biasing force of the spring 150, the pressure may cause the piston 140 to travel downward within the piston bore 142. Because the area for providing the actuating force on the piston 140 (the back pressure port 112) is apart from the area where the flow is controlled (the orifice 120), the actuating force provided by the exhaust pressure acts on the piston 140 substantially independent of the effect of dynamic pressure created by the flow of gas through the orifice 120. The downward motion of the piston 140, in turn, causes the downward motion of the shaft 130 within the valve bore 135. As the shaft 130 moves downward, the orifices 120 may align with the annular recesses 134, and the flow area through each orifice 120 may increase. As a result, more gas may be permitted to flow from the upstream side 2 of the valve to the downstream side 3 of the valve through the orifice 120. As more gas is permitted to flow from the upstream side 2 of the valve 100, the level of exhaust back pressure in the exhaust manifold may be reduced. When the level of exhaust pressure becomes equal to or slightly less than the biasing force of the spring 150, the spring 150 causes the piston 140 to move upward within the piston bore. This, in turn, causes the shaft 130 to move upward within the valve bore 135 and reduce the size of the total orifice flow area. In this manner, the level of exhaust back pressure may be maintained substantially near the level of the exhaust pressure limit of the engine, and may be controlled so as to optimize the engine retarding power.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

What is claimed is:

1. A method of controlling exhaust pressure in an engine exhaust system having a first rotatable butterfly valve adapted to rotate about an axis of rotation and to selectively restrict exhaust flow through the exhaust system, a passage for selectively permitting exhaust flow through said first valve, a bore formed in said first rotatable butterfly valve coaxial with the axis of rotation, and a second valve for selectively controlling exhaust flow through the passage, wherein at least a portion of said second valve is disposed within the bore formed in said first rotatable butterfly valve, said method comprising the steps of:

closing the first valve;

generating exhaust pressure in the exhaust system; and opening the second valve in response to the generation of exhaust pressure in the exhaust system.

2. The method of claim 1, wherein exhaust pressure provides opening force for the second valve.

3. The method of claim 1, wherein hydraulic pressure provides opening force for the second valve.

4. The method of claim 1, wherein pneumatic pressure provides opening force for the second valve.

5. The method of claim 1, wherein mechanically applied pressure provides opening force for the second valve.

6. The method of claim 1, wherein an opening direction of the second valve is substantially orthogonal to exhaust flow through the passage.

7. The method of claim 1, wherein control of exhaust pressure in the engine provides exhaust braking.

8. A method of controlling exhaust pressure in an engine having an exhaust system, a first rotatable butterfly valve disposed downstream of the exhaust system and adapted to rotate about an axis of rotation, a passage extending through said first rotatable butterfly valve, a bore formed in said first rotatable butterfly valve coaxial with the axis of rotation, a second valve having a first end adapted to control exhaust flow through said passage and a second end adapted to receive an actuation force for said second valve, wherein at least a portion of the first end of said second valve is disposed within the bore formed in said first rotatable butterfly valve, said method comprising the steps of:

closing the first rotatable butterfly valve;

applying exhaust pressure to the first end of the second valve in a direction substantially orthogonal to an actuation direction of the second valve; and applying an actuation force to the second end of the second valve to open the second valve and control the exhaust pressure in the exhaust system.

9. The method of claim 8, wherein the step of applying an actuation force comprises the step of applying exhaust pressure to the second end of the second valve.

10. The method of claim 8, wherein the step of applying an actuation force comprises the step of applying hydraulic pressure to the second end of the second valve.

11. The method of claim 8, wherein the step of applying an actuation force comprises the step of applying mechanical force to the second end of the second valve.

12. The method of claim 8, wherein the step of applying an actuation force comprises the step of applying pneumatic pressure to the second end of the second valve.

13. An apparatus for controlling exhaust pressure in an engine exhaust system comprising:

a first rotatable butterfly valve disposed in the exhaust system and adapted to rotate about an axis of rotation;

a bore formed in said first rotatable butterfly valve coaxial with the axis of rotation;

a passage extending through said first rotatable butterfly valve and intersecting said bore; and a second valve incorporated into said first rotatable butterfly valve, said second valve having a first end slidably disposed in said bore and adapted to control exhaust flow through said passage and a second end adapted to receive an actuation force for said second valve.

14. An apparatus for controlling exhaust pressure in an internal combustion engine having an exhaust system, said apparatus comprising:

a first valve disposed in the exhaust system, said first valve adapted to rotate about an axis of rotation;

a bore formed in said first valve coaxial with the axis of rotation;

a passage extending from an upstream to a downstream side of said first valve; and a second valve having at least a portion disposed in said valve bore.

15. The apparatus of claim 14, wherein the portion of said second valve disposed in said valve bore comprises a shaft slidably disposed in said valve bore.

16. The apparatus of claim 15, further comprising a means for actuating the pressure control means, wherein said actuating means is adapted to move said shaft between a first position in which exhaust is substantially prevented from flowing through said passage, and a second position in which exhaust is permitted to flow through said passage.

17. The apparatus of claim 16, wherein the actuating means comprises:

a piston operatively connected to the shaft; and means for applying exhaust pressure to the piston.

18. The apparatus of claim 16, wherein the actuating means comprises:

a piston operatively connected to the shaft; and means for applying fluid pressure to the piston.

19. The apparatus of claim 16, wherein said actuating means comprises:

a piston operatively connected to said shaft; and means for applying hydraulic pressure to the piston.

20. The apparatus of claim 16, further comprising a spring biasing said shaft in the first position.

21. The apparatus of claim 19, further comprising:

a pin hole formed in the lower end of said shaft; and a hinge pin operatively connected to said piston, said hinge pin loosely fitted in said pin hole.

22. The apparatus of claim 14, wherein the passage comprises: a plurality of orifices formed in said first valve, each of said orifices defining an exhaust gas flowpath through said first valve; and wherein the second valve comprises: a shaft slidably disposed in said bore; and a plurality of annular recesses formed in said shaft.

23. The apparatus of claim 22, further comprising actuating means for moving said shaft between a first position in which gas is substantially prevented from flowing through said orifices, and a second position in which said annular recesses align with said orifices and gas is permitted to flow through each orifice.

24. An apparatus for controlling exhaust pressure in an internal combustion engine having an exhaust system including a longitudinally extending exhaust pipe, said apparatus comprising:

a first rotatable butterfly valve disposed in the exhaust system and having a bore formed along an axis of rotation;

a second valve disposed within said first rotatable butterfly valve bore; and means for opening the second valve in a direction substantially orthogonal to the longitudinally extending exhaust pipe.

25. The apparatus of claim 24, wherein the second valve comprises a shaft slidably disposed in the bore formed in said first valve.

26. The apparatus of claim 24 further comprising means for actuating the second valve responsive to exhaust pressure in the exhaust system.

27. An apparatus for controlling exhaust pressure in an internal combustion engine, the apparatus comprising:

a housing;

a first valve disposed in said housing;

an orifice formed in said first valve, wherein said orifice defines an exhaust flowpath through said valve; and a second valve comprising a shaft slidably disposed in a bore formed in said first valve, wherein said bore intersects with said orifice.

* * * * *